US008366838B2

(12) United States Patent
Seetharaman et al.

(10) Patent No.: US 8,366,838 B2
(45) Date of Patent: Feb. 5, 2013

(54) MODERATE DENSITY, LOW DENSITY, AND EXTREMELY LOW DENSITY SINGLE CRYSTAL ALLOYS FOR HIGH AN$^2$ APPLICATIONS

(75) Inventors: Venkatarama K. Seetharaman, Rocky Hill, CT (US); Alan D. Cetel, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 119 days.

(21) Appl. No.: 12/634,008

(22) Filed: Dec. 9, 2009

(65) Prior Publication Data

US 2010/0086411 A1 Apr. 8, 2010

Related U.S. Application Data

(63) Continuation of application No. 11/638,084, filed on Dec. 13, 2006, now Pat. No. 7,704,332.

(51) Int. Cl.
*C22C 19/05* (2006.01)

(52) U.S. Cl. ..... 148/404; 148/428; 420/444

(58) Field of Classification Search ..... None
See application file for complete search history.

(56) References Cited

U.S. PATENT DOCUMENTS

| | | | | |
|---|---|---|---|---|
| 5,482,789 | A | 1/1996 | O'Hara et al. | |
| 6,641,929 | B2 | 11/2003 | Kelly et al. | |
| 7,704,332 | B2 * | 4/2010 | Seetharaman et al. | 148/404 |
| 2006/0057018 | A1 * | 3/2006 | Hobbs et al. | 420/444 |
| 2009/0196760 | A1 * | 8/2009 | Harada et al. | 416/241 R |

FOREIGN PATENT DOCUMENTS

| | | | |
|---|---|---|---|
| EP | 0208645 | A2 | 1/1987 |
| EP | 0225837 | A2 | 6/1987 |
| EP | 1319729 | A1 | 6/2003 |
| EP | 1568794 | A1 | 8/2005 |
| EP | 1642989 | A2 | 4/2006 |

* cited by examiner

*Primary Examiner* — George Wyszomierski
(74) *Attorney, Agent, or Firm* — Backman & LaPointe, P.C.

(57) ABSTRACT

A single crystal alloy for high AN$^2$ applications has a composition consisting essentially of from 4.0 to 10 wt % chromium, from 1.0 to 2.5 wt % molybdenum, up to 5.0 wt % tungsten, from 3.0 to 8.0 wt % tantalum, from 5.5 to 6.25 wt % aluminum, from 6.0 to 17 wt % cobalt, up to 0.2 wt % hafnium, from 4.0 to 6.0 wt % rhenium, from 1.0 to 3.0 wt % ruthenium, and the balance nickel. Further, these single crystal alloys have a total tungsten and molybdenum content in the range of from 1.0 to 7.5 wt %, preferably from 2.0 to 7.0 wt %, a total refractory element content in the range of from 9.0 to 24.5 wt %, preferably from 13 to 22 wt %, a ratio of rhenium to a total refractory element content in the range of from 0.16 to 0.67, preferably from 0.20 to 0.45, a density in the range of from 0.300 to 0.325 lb/in$^3$, and a specific creep strength in the range from $106\times10^3$ to $124\times10^3$ inches. These alloys provide (a) increased creep strength for a given density and (b) specific creep strengths as high as or higher than all 2$^{nd}$ generation single crystal alloys with a significant decrease in density.

14 Claims, No Drawings

MODERATE DENSITY, LOW DENSITY, AND EXTREMELY LOW DENSITY SINGLE CRYSTAL ALLOYS FOR HIGH $AN^2$ APPLICATIONS

CROSS-REFERENCE TO RELATED APPLICATION(S)

The present application is a continuation of U.S. patent application Ser. No. 11/638,084, filed Dec. 13, 2006, entitled MODERATE DENSITY, LOW DENSITY, AND EXTREMELY LOW DENSITY SINGLE CRYSTAL ALLOYS FOR HIGH $AN^2$ APPLICATIONS, now U.S. Pat. No. 7,704,332.

BACKGROUND OF THE INVENTION (1) Field of the Invention

The present invention relates to lower density single crystal alloys that have particular use in turbine engine components.

(2) Prior Art

High rotor speed turbine engine components, such as turbine blades, require materials with as low density as possible while maintaining reasonable levels of high temperature creep-rupture strength. Alloy design philosophy has previously been to achieve maximum creep capability without undue regard to alloy density. New engine designs require that extremely high levels of performance be achieved, which can only be met at very high $AN^2$ conditions where A=Area; N=Rotor speed. This in turn necessitates a new look at alloy design philosophy. For advanced high rotor speed designs, turbine blade weight (density) is critical to minimize the blade pull on the disk and thus minimize the overall disk size. Current second generation single crystal alloys with densities ranging from 0.312 to 0.323 lb/in$^3$ are widely deployed in production, while third and fourth generation single crystal alloys with increasing strength capability have correspondingly higher densities ranging from 0.324 to 0.331 lb/in$^3$. If reduced alloy density can be achieved for a given level of creep capability, significant savings in engine weight and increased engine performance would result.

SUMMARY OF THE INVENTION

Three classes of alloys are proposed in the instant application to meet advanced engine requirements. The first class of alloys is associated with moderate density less than or equal to 0.325 lb/in$^3$, preferably in the range of 0.320 to 0.325 lb/in$^3$, and provide a relatively high creep strength and specific strength of $120\times10^3$ to $124\times10^3$ inches. Alloys belonging to the second class possess fairly low densities in the range 0.310 to 0.320 lb/in$^3$ and a creep strength in the range of from $112\times10^3$ to $120\times10^3$ inches. The third class of alloys has an extremely low density (0.310 lb/in$^3$ or less, preferably in the range of from 0.300 to 0.310 lb/in$^3$) with a moderate to high creep strength and a specific creep strength capability in the range of $106\times10^3$-$110\times10^3$ inches. Throughout this application, creep strength and specific creep strength are defined in terms of the stress that would produce a typical rupture life of 300 hours at a test temperature of 1800° F.

In accordance with the present invention, a single crystal alloy has a composition consisting essentially of from 4.0 to 10 wt % chromium, from 1.0 to 2.5 wt % molybdenum, up to 5.0 wt % tungsten, from 3.0 to 8.0 wt % tantalum, from 5.5 to 6.25 wt % aluminum, from 6.0 to 17 wt % cobalt, up to 0.2 wt % hafnium, from 4.0 to 6.0 wt % rhenium, from 1.0 to 3.0 wt % ruthenium, and the balance nickel. Further, the single crystal alloys of the present invention have a total tungsten and molybdenum content in the range of from 1.0 to 7.5 wt %, preferably 2.0 to 7.0 wt %, and a total refractory content (Mo+W+Ta+Re+Ru) in the range of from 9 to 24.5 wt %, preferably 13 to 22 wt %. Still further, the single crystal alloys of the present invention have a ratio of rhenium to the total refractory content in the range of from 0.16 to 0.67, preferably 0.20 to 0.45.

Other details of the low density single crystal alloys for high $AN^2$ applications, as well as other objects and advantages attendant thereto, are set forth in the following detailed description.

DETAILED DESCRIPTION OF THE PREFERRED EMBODIMENT(S)

In accordance with the present invention, there is provided single crystal alloys from which turbine engine components, such as high pressure turbine blades, may be formed. The alloys of the present have a composition which consists essentially of from 4.0 to 10 wt % chromium, from 1.0 to 2.5 wt % molybdenum, up to 5.0 wt % tungsten, from 3.0 to 8.0 wt % tantalum, from 5.5 to 6.25 wt % aluminum, from 6.0 to 17 wt % cobalt, up to 0.2 wt % hafnium, from 4.0 to 6.0 wt % rhenium, from 1.0 to 3.0 wt % ruthenium, and the balance nickel. The alloys of the present invention preferably have a total tungsten and molybdenum content in the range of from 1.0 to 7.5 wt %, preferably 2.0 to 7.0 wt %, a total refractory element content (the sum of Mo+W+Ta+Re+Ru) in the range of from 9 to 24.5 wt %, preferably from 13 to 22 wt %, a ratio of rhenium to a total refractory element content in the range of from 0.16 to 0.67, preferably from 0.20 to 0.45, a density in the range of from 0.300 to 0.325 lb/in$^3$, and a specific creep strength in the range of from $106\times10^3$ to $124\times10^3$ inches. The specific creep strength may be determined as stress for 300 hours rupture life at 1800 degrees Fahrenheit divided by density.

The alloys of the present invention are characterized by very low levels of W+Mo, moderate levels of total refractory element content, but high ratios of Re to total refractory element content in order to achieve reduced density without significantly affecting creep strength. Previously, attempts to design lower density alloys have employed low levels of the refractory elements and very low levels of rhenium or rhenium-free compositions. These attempts resulted in low-density alloys, at the expense of creep strength. The alloys of the present invention demonstrate that higher levels of rhenium can compensate for removal of even larger quantities of the other refractory elements (Mo, W, Ta, and Ru). Creep strength levels greater than current $2^{nd}$ generation single crystal alloys can be obtained at reduced densities and specific creep strengths approaching or exceeding that of PWA 1484 can be obtained with a significant reduction in density. Using the approach of the present invention, strength levels can be maintained while lowering density or small reductions in creep strength can be traded for significant decreases in density. Such tradeoffs can be achieved while maintaining similar levels of specific creep strength.

The moderate density class of alloys are characterized by densities less than or equal to 0.325 lb/in$^3$, preferably in the range of from 0.320 to 0.325 lb/in$^3$, a specific creep strength in the range of $120\times10^3$-$124\times10^3$ inches, a tungsten and molybdenum content of 7.0 wt % or less, preferably in the range of 6.0 to 7.0 wt %, a total refractory element content of 23.5 wt % or less, preferably in the range of from 20.5 to 22 wt %, and a ratio of rhenium to total refractory element content in the range of 0.21 to 0.41, preferably from 0.21 to 0.30. This class of alloys may have a composition consisting of from 4.0 to 8.0 wt % chromium, from 1.0 to 2.0 wt % molybdenum, up to 5.0 wt % tungsten, from 7.0 to 8.0 wt % tantalum, from 5.65 to 6.25 wt % aluminum, from 12 to 17 wt % cobalt, up to 0.2 wt % hafnium, from 5.0 to 6.0 wt % rhenium, from 1.5 to 2.5 wt % ruthenium, and the balance nickel.

Exemplary compositions of moderate density alloys in accordance with the present invention are as follows:

Alloy A has a composition of 5.0 wt % chromium, 1.5 wt % molybdenum, 5.0 wt % tungsten, 8.0 wt % tantalum, 5.65 wt % aluminum, 12.5 wt % cobalt, 0.1 wt % hafnium, 5.0 wt % rhenium, 2.0 wt % ruthenium, and the balance nickel. The total molybdenum plus tungsten content is 6.5 wt %. The total refractory element content is 21.5 wt % and the ratio of rhenium to total refractory element content is 0.23. This alloy has a density of 0.324 lb/in$^3$, and specific creep strength of $120\times10^3$ inches;

Alloy B has a composition of 5.0 wt % chromium, 1.5 wt % molybdenum, 5.0 wt % tungsten, 8.0 wt % tantalum, 6.0 wt % aluminum, 16.5 wt % cobalt, 0.1 wt % hafnium, 5.0 wt % rhenium, 2.0 wt % ruthenium, and the balance nickel. The total molybdenum plus tungsten content is 6.5 wt %. The total refractory element content is 21.5 wt % and the ratio of rhenium to total refractory element content is 0.23. This alloy has a density of 0.323 lb/in$^3$, and specific creep strength of $124\times10^3$ inches; and Alloy C has a composition of 5.0 wt % chromium, 1.5 wt % molybdenum, 5.0 wt % tungsten, 7.0 wt % tantalum, 6.0 wt % aluminum, 12.5 wt % cobalt, 0.1 wt % hafnium, 5.0 wt % rhenium, 2.0 wt % ruthenium, and the balance nickel. The total molybdenum plus tungsten content is 6.5 wt %. The total refractory element content is 20.5 wt % and the ratio of rhenium to total refractory element content is 0.24. This alloy has a density of 0.321 lb/in$^3$, and specific creep strength of $123\times10^3$ inches.

Low density single crystal alloys in accordance with the present invention may have density in the range of from 0.310 to 0.320 lb/in$^3$ and a specific creep strength in the range of from $112\times10^3$ to $120\times10^3$ inches. Such alloys may consist of from 4.0 to 8.0 wt % chromium, from 4.5 to 5.5 wt % tungsten, from 1.0 to 2.0 wt % molybdenum, from 4.0 to 6.0 wt % tantalum, from 5.5 to 6.25 wt % aluminum, from 6.0 to 13 wt % cobalt, up to 0.2 wt % hafnium, from 4.0 to 5.25 wt % rhenium, from 1.5 to 2.5 wt % ruthenium, and the balance nickel. The alloy may have a total refractory element content up to 21.25 wt %, preferably from 16 to 20 wt %. The ratio of rhenium to the total refractory element content may be greater than 0.18, preferably in the range of from 0.26 to 0.29.

Exemplary compositions of low-density alloys in accordance with the present invention are as follows:

Alloy D has a composition of 5.0 wt % chromium, 5.0 wt % tungsten, 1.5 wt % molybdenum, 6.0 wt % tantalum, 6.0 wt % aluminum, 12.5 wt % cobalt, 0.1 wt % hafnium, 5.0 wt % rhenium, 2.0 wt % ruthenium, and the balance nickel. The total molybdenum and tungsten content is 6.5 wt %. The total refractory element content is 17.5 wt % and the ratio of rhenium to total refractory element content is 0.29. This alloy has a density of 0.315 lb/in$^3$ and specific creep strength of $119\times10^3$ inches.

Alloy E has a composition of 5.0 wt % chromium, 4.5 wt % tungsten, 1.5 wt % molybdenum, 6.0 wt % tantalum, 6.0 wt % aluminum, 12.5 wt % cobalt, 0.1 wt % hafnium, 4.5 wt % rhenium, 2.0 wt % ruthenium, and the balance nickel. The total molybdenum and tungsten content is 6.0 wt %. The total refractory element content is 16.5 wt % and the ratio of rhenium to total refractory element content is 0.27. This alloy has a density of 0.313 lb/in$^3$ and specific creep strength of $113\times10^3$ inches.

Alloy F has a composition of 5.0 wt % chromium, 5.0 wt % tungsten, 1.5 wt % molybdenum, 6.0 wt % tantalum, 6.0 wt % aluminum, 6.0 wt % cobalt, 0.1 wt % hafnium, 5.0 wt % rhenium, 2.0 wt % ruthenium, and the balance nickel. The total molybdenum and tungsten content is 6.5 wt %. The total refractory element content is 19.5 wt % and the ratio of rhenium to total refractory element content is 0.26. This alloy has a density of 0.319 lb/in$^3$ and specific creep strength $120\times10^3$ inches.

The extremely low density class of alloys are characterized by densities less than or equal to 0.310 lb/in$^3$, preferably in the range of from 0.300 lb/in$^3$ to 0.310 lb/in$^3$, specific creep strength in the range of from $106\times10^3$ to $110\times10^3$ inches, a tungsten and molybdenum content of less than 7.5 wt %, preferably less than 4.0 wt %, a total refractory element content of less than or equal to 21.0 wt %, preferably in the range of from 13 to 14 wt %, and a ratio of rhenium to total refractory element content greater than or equal to 0.24, preferably in the range of from 0.38 to 0.43. This class of alloys may have a composition (with minimal or no tungsten) consisting of from 8.0 to 10 wt % chromium, up to 5.0 wt % tungsten from 1.5 to 2.5 wt % molybdenum, from 4.0 to 5.0 wt % tantalum, from 5.65 to 6.25 wt % aluminum, from 11.5 to 13.5 wt % cobalt, up to 0.2 wt % hafnium, from 5.0 to 6.0 wt % rhenium, from 1.5 to 2.5 wt % ruthenium, and the balance nickel.

Exemplary compositions of extremely low-density alloys in accordance with the present invention are as follows:

Alloy G has a composition of 8.0 wt % chromium, 0 wt % tungsten, 2.0 wt % molybdenum, 4.0 wt % tantalum, 6.0 wt % aluminum, 12.5 wt % cobalt, 0.1 wt % hafnium, 6.0 wt % rhenium, 2.0 wt % ruthenium, and the balance nickel. The total molybdenum plus tungsten content is 2.0 wt %. The total refractory element content is 14 wt % and the ratio of rhenium to total refractory element content is 0.43. This alloy has a density of 0.307 lb/in$^3$, and specific creep strength of $110\times10^3$ inches.

Alloy H has a composition of 10.0 wt % chromium, 0 wt % tungsten, 2.0 wt % molybdenum, 4.0 wt % tantalum, 6.0 wt % aluminum, 12.5 wt % cobalt, 0.1 wt % hafnium, 5.5 wt % rhenium, 2.0 wt % ruthenium, and the balance nickel. The total molybdenum plus tungsten content is 2.0 wt %. The total refractory element content is 13.5 wt % and the ratio of rhenium to total refractory element content is 0.41. This alloy has a density of 0.304 lb/in$^3$ and specific creep strength of $110\times10^3$ inches; and Alloy I has a composition of 10.0 wt % chromium, 0 wt % tungsten, 2.0 wt % molybdenum, 4.0 wt % tantalum, 6.0 wt % aluminum, 12.5 wt % cobalt, 0.1 wt % hafnium, 5.0 wt % rhenium, 2.0 wt % ruthenium, and the balance nickel. The total molybdenum plus tungsten content is 2.0 wt %. The total refractory element content is 13 wt % and the ratio of rhenium to total refractory element content is 0.38. This alloy has a density of 0.302 lb/in$^3$ and a specific creep strength of $106\times10^3$ inches.

At rhenium contents of from 5.0 to 6.0 wt %, ruthenium contents of from 1.5 to 2.5 wt %, and cobalt contents in the range of from 12 to 17 wt %, alloy compositions can avoid the formation of microstructural phase instabilities, such as TCP (Topologically Close-packed Phases) and SRZ (Secondary Reaction Zone) instabilities.

The foregoing alloy compositions and properties are set forth in the following Table I.

TABLE 1

Alloy Compositions and Properties

| Alloy | Density ($lb/in^3$) | Specific Creep Strength ($10^3$ inch) | Cr | Mo | W | Ta | Al | Co | Hf | Re | Ru | W + Mo | Total Refractory Element (wt %) | Re/Refract |
|---|---|---|---|---|---|---|---|---|---|---|---|---|---|---|
| A | 0.324 | 120 | 5 | 1.5 | 5 | 8 | 5.65 | 12.5 | .1 | 5 | 2 | 6.5 | 21.5 | 0.23 |
| B | 0.323 | 124 | 5 | 1.5 | 5 | 8 | 6 | 16.5 | .1 | 5 | 2 | 6.5 | 21.5 | 0.23 |
| C | 0.321 | 123 | 5 | 1.5 | 5 | 7 | 6 | 12.5 | .1 | 5 | 2 | 6.5 | 20.5 | 0.24 |
| D | 0.315 | 119 | 5 | 1.5 | 5 | 6 | 6 | 12.5 | .1 | 5 | 2 | 6.5 | 17.5 | 0.29 |
| E | 0.313 | 113 | 5 | 1.5 | 4.5 | 6 | 6 | 12.5 | .1 | 4.5 | 2 | 6 | 16.5 | 0.27 |
| F | 0.319 | 120 | 5 | 1.5 | 5 | 6 | 6 | 6 | .1 | 5 | 2 | 6.5 | 19.5 | 0.26 |
| G | 0.307 | 110 | 8 | 2 | 0 | 4 | 6 | 12.5 | .1 | 6 | 2 | 2 | 14 | 0.43 |
| H | 0.304 | 110 | 10 | 2 | 0 | 4 | 6 | 12.5 | .1 | 5.5 | 2 | 2 | 13.5 | 0.41 |
| I | 0.302 | 106 | 10 | 2 | 0 | 4 | 6 | 12.5 | .1 | 5 | 2 | 2 | 13 | 0.38 |

Chemical compositions are given in weight %; units for density and specific creep strength are in $lb/in^3$ and $10^3$ inch, respectively. The term Re/Refract denotes the ratio of the rhenium content to the total refractory element content in the alloy.

The single crystal alloys of the present invention may be cast using standard directional solidification methods known in the art. Similarly, a turbine engine component, such as a high-pressure turbine blade, may be formed from the alloys of the present invention using standard directional solidification methods known in the art.

It is apparent that there has been provided in accordance with the present invention, three classes (moderate, low, and extremely low density) of single crystal alloys for high $AN^2$ applications which fully satisfy the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A single crystal alloy having a composition consisting of from 4.0 to 10 wt % chromium, from 1.0 to 2.5 wt % molybdenum, from 3.0 to 8.0 wt % tantalum, from 5.5 to 6.25 wt % aluminum, from 6.0 to 17 wt % cobalt, up to 0.2 wt % hafnium, from 4.0 to 6.0 wt % rhenium, from 1.0 to 3.0 wt % ruthenium, and the balance nickel, a density in the range of from 0.300 to 0.325 $lb/in^3$, and a specific creep strength in the range of from $106\times10^3$ to $124\times10^3$ inches.

2. The single crystal alloy of claim 1, further having a total refractory element content (Mo+W+Ta+Re+Ru) in the range of from 13 to 22 wt %.

3. The single crystal alloy of claim 1, further having a ratio of rhenium to a total refractory element content in the range of from 0.16 to 0.67.

4. The single crystal alloy of claim 1, further having a ratio of rhenium to a total refractory element content in the range of from 0.20 to 0.45.

5. The single crystal alloy of claim 1, wherein said alloy has a density less than 0.310 $lb/in^3$ and a specific creep strength in the range of $106\times10^3$ to $110\times10^3$ inches.

6. The single crystal alloy of claim 5, wherein said density is in the range of from 0.300 to 0.310 $lb/in^3$.

7. The single crystal alloy of claim 1 having a composition consisting of from 5.0 to 10 wt % chromium, from 1.0 to 2.5 wt % molybdenum, from 3.0 to 8.0 wt % tantalum, from 5.5 to 6.25 wt % aluminum, from 6.0 to 17 wt % cobalt, up to 0.2 wt % hafnium, from 4.0 to 6.0 wt % rhenium, from 1.0 to 3.0 wt % ruthenium, and the balance nickel, and a specific creep strength in the range of $120\times10^3$ to $124\times10^3$ inches.

8. The single crystal alloy of claim 7, wherein said density is in the range of from 0.320 to 0.325 $lb/in^3$.

9. The single crystal alloy of claim 1, wherein said alloy has a density in the range of from 0.310 to 0.320 $lb/in^3$ and a specific creep strength in the range of $112\times10^3$ to $120\times10^3$ inches.

10. A turbine engine component formed from the single crystal alloy of claim 1.

11. The turbine engine component of claim 10, further having a total refractory element content in the range of from 13 to 22 wt %.

12. The turbine engine component of claim 10, further having a ratio of rhenium to a total refractory element content in the range of from 0.16 to 0.67.

13. The turbine engine component of claim 10, further having a ratio of rhenium to a total refractory element content in the range of from 0.20 to 0.45.

14. The turbine engine component of claim 10, wherein said component comprises a turbine blade.

* * * * *